US010418167B2

(12) United States Patent
Yoshinaka et al.

(10) Patent No.: US 10,418,167 B2
(45) Date of Patent: Sep. 17, 2019

(54) INDUCTOR COMPONENT

(71) Applicant: Murata Manufacturing Co., Ltd., Kyoto (JP)

(72) Inventors: Keiichi Yoshinaka, Nagaokakyo (JP); Masayuki Yoneda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 133 days.

(21) Appl. No.: 15/847,973

(22) Filed: Dec. 20, 2017

(65) Prior Publication Data

US 2018/0197674 A1 Jul. 12, 2018

(30) Foreign Application Priority Data

Jan. 10, 2017 (JP) ..... 2017-002026

(51) Int. Cl.

| | |
|---|---|
| ***H01F 5/00*** | (2006.01) |
| ***H01F 27/28*** | (2006.01) |
| ***H01F 27/32*** | (2006.01) |
| ***H01F 17/00*** | (2006.01) |
| ***H01F 27/29*** | (2006.01) |

(52) U.S. Cl.

CPC ..... *H01F 27/2885* (2013.01); *H01F 5/00* (2013.01); *H01F 17/0013* (2013.01); *H01F 27/2828* (2013.01); *H01F 27/292* (2013.01); *H01F 27/323* (2013.01)

(58) Field of Classification Search

CPC ..... H01F 27/00–36; H01F 5/00

USPC ..... 336/65, 83, 192, 200, 206–208, 232

See application file for complete search history.

(56) References Cited

U.S. PATENT DOCUMENTS

| | | | | |
|---|---|---|---|---|
| 6,580,350 | B1 * | 6/2003 | Kobayashi | H01F 17/0013 336/192 |
| 7,212,095 | B2 * | 5/2007 | Sato | H01F 17/0033 336/200 |
| 2012/0032767 | A1 * | 2/2012 | Iwasaki | H01F 17/0013 336/200 |

FOREIGN PATENT DOCUMENTS

| | | | |
|---|---|---|---|
| CN | 106062904 | A | 10/2016 |
| JP | H05-036532 | A | 2/1993 |
| WO | 2016-006542 | A1 | 1/2016 |

OTHER PUBLICATIONS

An Office Action; "Notification of Reasons for Refusal," mailed by the Japanese Patent Office dated Mar. 5, 2019, which corresponds to Japanese Patent Application No. 2017-002026 and is related to U.S. Appl. No. 15/847,973; with English language translation.

(Continued)

*Primary Examiner* — Tuyen T Nguyen

(74) *Attorney, Agent, or Firm* — Studebaker & Brackett PC

(57) ABSTRACT

An inductor component has an element body defined by a length, a height, and a width, a coil disposed in the element body and helically wound in the width direction, and first and second external electrodes disposed in the element body and electrically connected to the coil. The coil includes a plurality of coil conductor layers arranged side by side in the width direction. The plurality of coil conductor layers is each wound in parallel with a plane including the length direction and the height direction. At least one of the coil conductor layers has a shortest distance of 140 μm or less in at least one of the length and height directions between an inner circumferential surface of the coil conductor layer and an outer surface of the element body opposite to this inner circumferential surface.

10 Claims, 4 Drawing Sheets

(56) References Cited

OTHER PUBLICATIONS

An Office Action mailed by the Chinese Patent Office dated Mar. 21, 2019, which corresponds to Chinese Patent Application No. 201711008046.8 and is related to U.S. Appl. No. 15/847,973 with English language translation.

* cited by examiner

INDUCTOR COMPONENT

CROSS REFERENCE TO RELATED APPLICATIONS

This application claims benefit of priority to Japanese Patent Application 2017-002026 filed Jan. 10, 2017, the entire content of which is incorporated herein by reference.

TECHNICAL FIELD

The present disclosure relates to an inductor component.

BACKGROUND

A conventional inductor component is described in Japanese Laid-Open Patent Publication No. 5-36532. This inductor component includes an element body made up of multiple dielectric layers and multiple coil patterns disposed on the dielectric layers, and the multiple coil patterns are connected to each other to form a helical coil.

SUMMARY

Problem to be Solved by the Disclosure

In the conventional inductor component, delamination may occur between the coil and the element body or between the dielectric layers of the element body when heat is applied during manufacturing or use of the inductor component. As a result of intensive studies, the present inventors found that such delamination occurs in a center region in the element body.

Therefore, a problem to be solved by the present disclosure is to provide an inductor component reducing delamination between a coil and an element body or between multiple layers constituting the element body.

Solutions to the Problems

To solve the problem, an aspect of the present disclosure provides an inductor component comprising:

an element body defined by a length, a height, and a width;

a coil disposed in the element body and helically wound in the width direction; and first and second external electrodes disposed in the element body and electrically connected to the coil, wherein the coil includes a plurality of coil conductor layers arranged side by side in the width direction, wherein the plurality of coil conductor layers is each wound in parallel with a plane including the length direction and the height direction, wherein at least one of the coil conductor layers has a shortest distance of 140 μm or less in at least one of the length and height directions between an inner circumferential surface of the coil conductor layer and an outer surface of the element body opposite to this inner circumferential surface.

According to the inductor component of the present disclosure, at least a portion of the coil conductor layer can be arranged within a certain range from the outer surface of the element body (hereinafter referred to as an outer surface region of the element body). When the element body is degreased at a firing step of manufacturing of the inductor component, the degreasing proceeds from the outer surface of the element body toward the center and, since the coil conductor layer can be arranged in the outer surface region of the element body, both the coil conductor layer and the outer surface region of the element body are easily put into a degreased state. Therefore, variation in shrinkage behavior can be reduced in the coil conductor layer and the outer surface region of the element body, so that delamination can be reduced between the coil conductor layer and the element body or between the multiple layers constituting the element body.

In an embodiment of the inductor component, the shortest distance is 140 μm or less in the length direction and the height direction between the inner circumferential surface of the coil conductor layer and the outer surface of the element body opposite to this inner circumferential surface.

According to the embodiment, the delamination can further be reduced.

In an embodiment of the inductor component, all the coil conductor layers have the shortest distance of 140 μm or less between the inner circumferential surface of the coil conductor layer and the outer surface of the element body opposite to this inner circumferential surface.

According to the embodiment, the delamination can further be reduced.

In an embodiment of the inductor component, the length of the element body is 0.6 mm; the height of the element body is 0.4 mm;

in the length direction, a proportion of the shortest distance between the inner circumferential surface of the at least one coil conductor layer and the outer surface of the element body opposite to this inner circumferential surface to the length of the element body is 24% or less; and in the height direction, a proportion of the shortest distance between the inner circumferential surface of the at least one coil conductor layer and the outer surface of the element body opposite to this inner circumferential surface to the height of the element body is 36% or less.

According to the embodiment, the delamination can further be reduced.

In an embodiment of the inductor component, the shortest distance in the length direction between the inner circumferential surface of the coil conductor layer and the outer surface of the element body opposite to this inner circumferential surface is equal to or greater than the shortest distance in the height direction between the inner circumferential surface of the coil conductor layer and the outer surface of the element body opposite to this inner circumferential surface.

According to the embodiment, since the coil conductor layer can be formed into a shape closer to a true circle, the Q-value can be made higher.

In an embodiment of the inductor component, the outer surface of the element body includes a first end surface and a second end surface opposite to each other in the length direction and a top surface and a bottom surface opposite to each other in the height direction;

the first external electrode is disposed over the first end surface and the bottom surface; and the second external electrode is disposed over the second end surface and the bottom surface.

According to the embodiment, the first external electrode and the second external electrode are L-shaped electrodes. Since the external electrodes do not face each other such that the magnetic flux direction (width direction) is blocked, a loss due to the eddy current loss can be reduced.

In an embodiment of the inductor component, the length of the element body is greater than the height of the element body, and a line width of a portion of the at least one coil conductor layer extending in the height direction is smaller than a line width of a portion of the at least one coil conductor layer extending in the length direction.

According to the embodiment, since the line width of the portion of the coil conductor layer extending in the height direction is smaller than the line width of the portion of the coil conductor layer extending in the length direction, a distance can be kept between the portion of the coil conductor layer extending in the height direction and the first and second external electrodes. Since the coil conductor layer can be formed into a shape closer to a true circle, the Q-value can be made higher. The L-value can be adjusted by changing the line width of the portion of the coil conductor layer extending in the height direction and the line width of the portion of the coil conductor layer extending in the length direction. For example, by increasing the line width of the portion of the coil conductor layer extending in the length direction, the L-value can be reduced.

In an embodiment of the inductor component, the element body includes a first plane including the length direction and the height direction and intersecting the at least one coil conductor layer; the first plane includes at a center thereof a center region having a similar shape acquired by scaling down the first plane; the area of the center area is 25% of the area of the first plane; and the at least one coil conductor layer does not overlap the center region.

According to the embodiment, the coil conductor layer can be disposed in the outer surface region of the element body, and the variation in shrinkage behavior due to degreasing can be reduced in the coil conductor layer and the outer surface region of the element body, so that the delamination can be reduced.

An embodiment of the inductor component provides an inductor component comprising:

an element body defined by a length, a height, and a width;

a coil disposed in the element body and helically wound in the width direction; and first and second external electrodes disposed in the element body and electrically connected to the coil, wherein the length of the element body is greater than the height of the element body, wherein the coil includes a plurality of coil conductor layers arranged side by side in the width direction, wherein the plurality of coil conductor layers is each wound in parallel with a plane including the length direction and the height direction, wherein the at least one coil conductor layer has a line width of a portion of the coil conductor layer extending in the height direction smaller than a line width of a portion of the coil conductor layer extending in the length direction.

According to the embodiment, since the line width of the portion of the coil conductor layer extending in the height direction is smaller than the line width of the portion of the coil conductor layer extending in the length direction, the portion of the coil conductor layer extending in the height direction and the portion of the coil conductor layer extending in the length direction can be arranged in the outer surface region of the element body. Therefore, the delamination can be reduced between the coil conductor layer and the element body or between the multiple layers constituting the element body.

An embodiment of the inductor component provides an inductor component comprising:

an element body defined by a length, a height, and a width;

a coil disposed in the element body and helically wound in the width direction; and first and second external electrodes disposed in the element body and electrically connected to the coil, wherein the coil includes a plurality of coil conductor layers arranged side by side in the width direction, wherein the plurality of coil conductor layers is each wound in parallel with a plane including the length direction and the height direction, wherein the element body includes a first plane including the length direction and the height direction and intersecting at least one of the coil conductor layers, wherein the first plane includes at a center thereof a center region having a similar shape acquired by scaling down the first plane, wherein the area of the center area is 25% of the area of the first plane, and wherein the at least one coil conductor layer does not overlap the center region.

According to the embodiment, since the coil conductor layer does not overlap the center region of the element body, the coil conductor layer can be arranged in the outer surface region of the element body. Therefore, the delamination can be reduced between the coil conductor layer and the element body or between the multiple layers constituting the element body.

Effect of the Disclosure

According to the inductor component of the present disclosure, the delamination can be reduced between the coil and the element body or between the multiple layers constituting the element body.

DETAILED DESCRIPTION

An inductor component of an aspect of the present disclosure will now be described in detail with reference to shown embodiments.

First Embodiment

Figure 1:
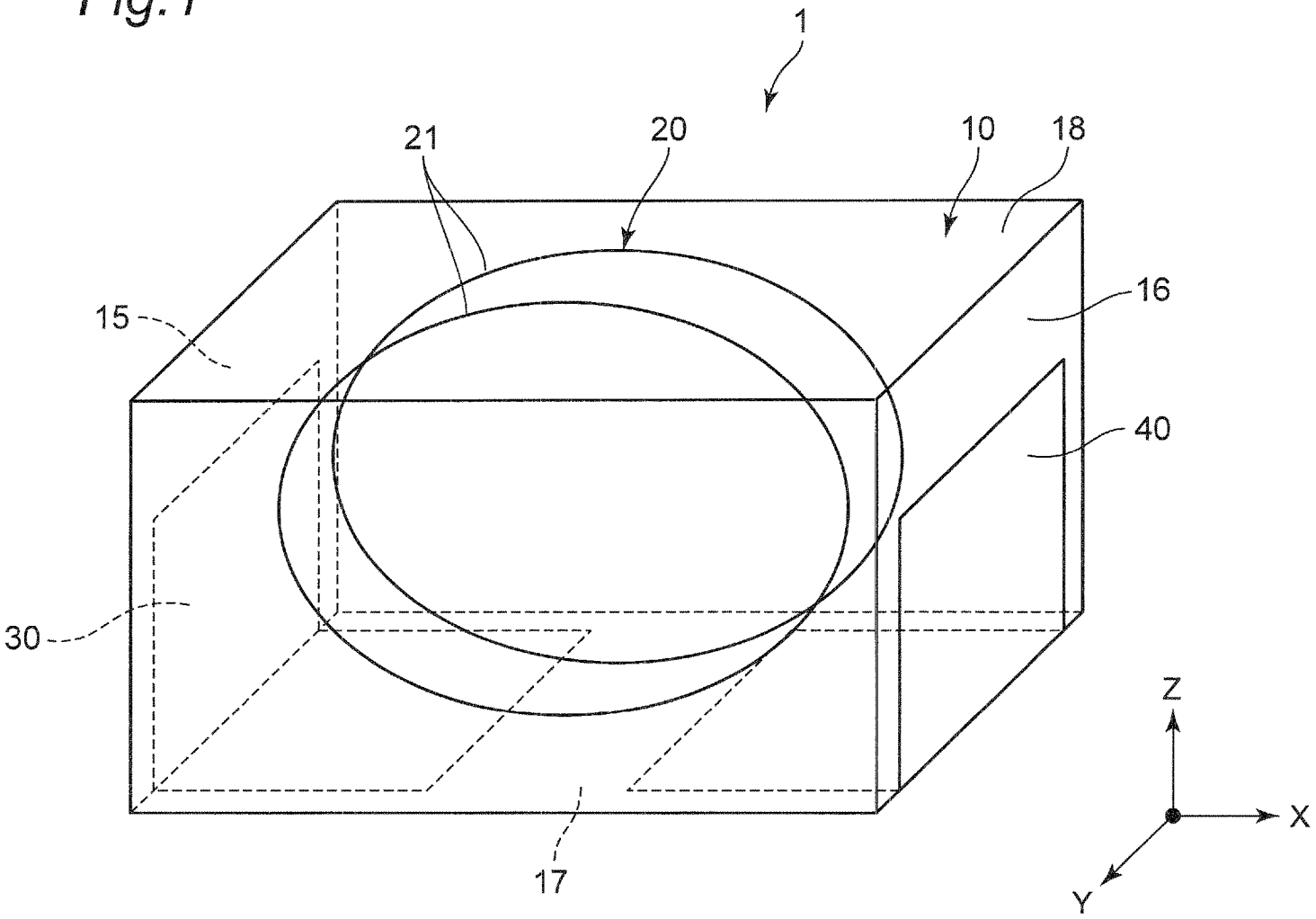
FIG. 1 is a schematic perspective view of a first embodiment of an inductor component of the present disclosure.
Figure 2:
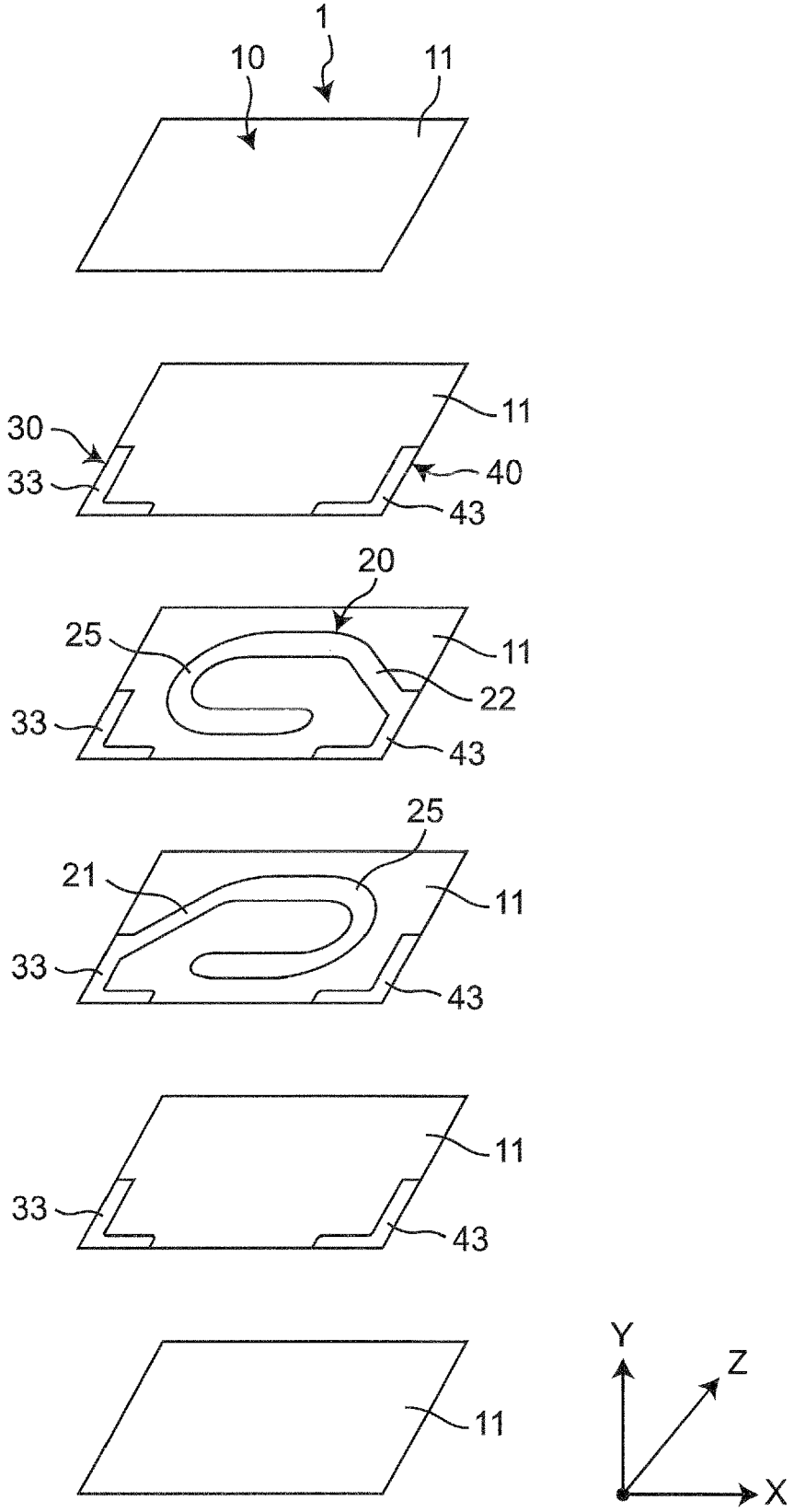
FIG. 2 is an exploded perspective view of the inductor component.

FIG. 1 is a schematic perspective view of a first embodiment of an inductor component and FIG. 2 is an exploded perspective view of the inductor component. As shown in FIGS. 1 and 2, an inductor component 1 has an element body 10, a helical coil 20 disposed inside the element body 10, and a first external electrode 30 and a second external electrode 40 disposed in the element body 10 and electrically connected to the coil 20. In FIG. 1, the coil 20 is schematically represented by two overlapping ellipses without showing a detailed structure.

The inductor component 1 is electrically connected via the first and second external electrodes 30, 40 to a wiring of a circuit board not shown. The inductor component 1 is used as an impedance matching coil (matching coil) of a high-frequency circuit, for example, and is used for an electronic device such as a personal computer, a DVD player, a digital camera, a TV, a portable telephone, automotive electronics, and medical/industrial machines. However, the inductor component 1 is not limited to these uses and is also usable for a tuning circuit, a filter circuit, and a rectifying/smoothing circuit, for example.

The element body 10 is defined by a length, a height, and a width and is formed into a substantially rectangular parallelepiped shape. The length direction is an X-direction, the width direction is a Y-direction, and the height direction is a Z-direction. The X-, Y-, Z-directions are orthogonal to each other. The outer surface of the element body 10 includes a first end surface 15 and a second end surface 16 opposite to each other in the length direction (X-direction) and a top surface 18 and a bottom surface 17 opposite to each other in the height direction (Z-direction).

The element body 10 is formed by laminating multiple insulating layers 11. The lamination direction of the multiple insulating layers 11 is the width direction (Y-direction). The insulating layers 11 are made of a material mainly composed of borosilicate glass or a material such as ferrite and resin, for example. In the element body 10, an interface between the multiple insulating layers 11 may not be clear due to firing.

The first external electrode 30 and the second external electrode 40 are made of a conductive material such as Ag, Cu, Au, and an alloy mainly composed thereof, for example. The first external electrode 30 has an L-shape disposed over the first end surface 15 and the bottom surface 17. The second external electrode 40 has an L-shape disposed over the second end surface 16 and the bottom surface 17.

The first external electrode 30 and the second external electrode 40 have a configuration in which pluralities of external electrode conductor layers 33, 34 embedded in the insulating layers 11 of the element body 10 are laminated. The external electrode conductor layers 33 have an L-shape with portions extending along the first end surface 15 and the bottom surface 17, and the external electrode conductor layers 43 have an L-shape with portions extending along the second end surface 16 and the bottom surface 17. Consequently, since the external electrodes 30, 40 can be embedded in the element body 10, the inductor component can be reduced in size as compared to a configuration in which the external electrodes are externally attached to the element body 10. Additionally, the coil 20 and the external electrodes 30, 40 can be formed in the same steps, so that variations in the positional relationship between the coil 20 and the external electrodes 30, 40 can be reduced to decrease variations in electrical characteristics of the inductor component 1.

The coil 20 is made of the same conductive material as the first and second external electrodes 30, 40, for example. The coil 20 is helically wound in the Y-direction. One end of the coil 20 is in contact with the first external electrode 30 and the other end of the coil 20 is in contact with the second external electrode 40. Since the L-shaped first and second external electrodes 30, 40 do not face each other such that the magnetic flux direction (width direction) of the coil 20 is blocked, a loss due to the eddy current loss can be reduced.

The coil 20 has multiple coil conductor layers 25 serving as magnetic-flux generating portions, a first lead-out conductor layer 21 connected between one end of the one coil conductor layer 25 and the first external electrode 30, and a second lead conductor layer 22 connected between the other end of the other coil conductor layer 25 and the second external electrode 40. Although the coil conductor layers 25 and the first and second lead-out conductor layers 21, 22 are integrated without clear boundary, this is not a limitation and the coil conductor layers 25 and the first and second lead-out conductor layers 21, 22 may be made of different materials or by different construction methods so that boundaries may exist. Similarly, although the coil 20 and the first and second external electrodes 30, 40 are integrated without clear boundary, this is not a limitation and boundaries may exist.

The multiple coil conductor layers 25 are arranged side by side in the Y-direction. The multiple coil conductor layers 25 are each wound in parallel with a plane including the X- and Z-directions. Since the coil 20 is made up of the coil conductor layers 25 that can be microfabricated in this way, the inductor component 1 can be reduced in size and height.

Specifically, the coil conductor layers 25 are two layers and the coil conductor layers 25 are wound on the respective insulating layers 11. The coil conductor layers 25 adjacent in the Y-direction are electrically connected in series through a via conductor penetrating the insulating layers 11 in the thickness direction. The two coil conductor layers 25 are electrically connected to each other in series to constitute a helix. The coil conductor layers 25 each have the number of turns less than one and the two coil conductor layers 25 are connected to form a helical shape as the shape of the coil 20. In this case, a parasitic capacitance generated in the coil conductor layers 25 and a parasitic capacitance generated between the coil conductor layers 25 can be reduced, and the Q-value of the inductor component 1 can be improved.

Figure 3:
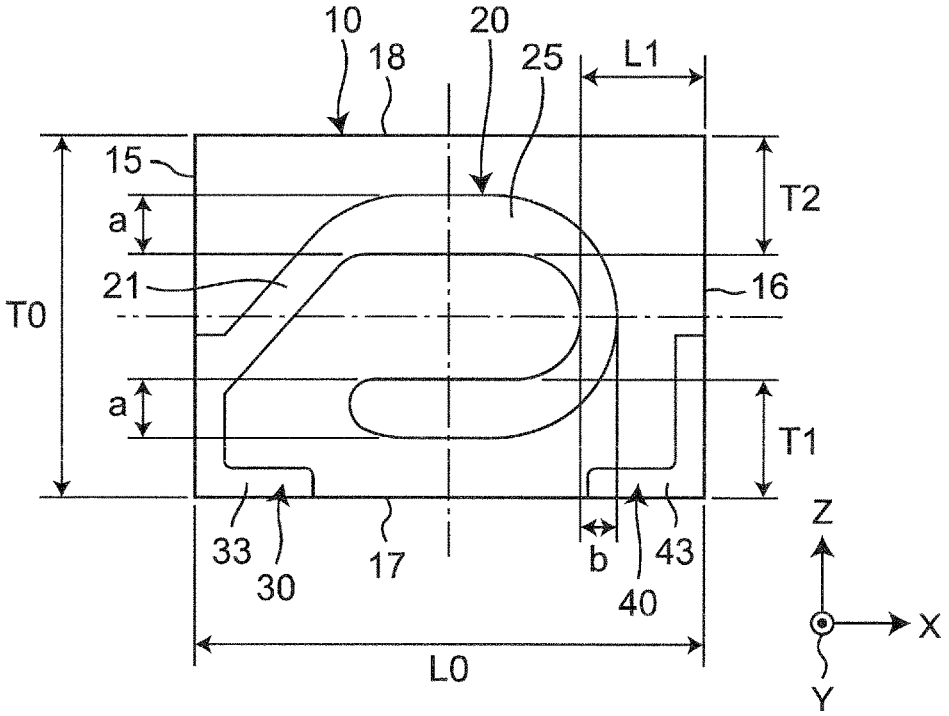
FIG. 3 is a simplified plane view of a coil conductor layer connected to a first external electrode.

FIG. 3 is a simplified plane view of the coil conductor layer 25 connected to the first external electrode 30. As shown in FIG. 3, a shortest distance L1 in the X-direction (length direction) is 140 μm or less between an inner circumferential surface of the coil conductor layer 25 on the second end surface 16 side and the second end surface 16 of the element body 10 opposite to this inner circumferential surface. A shortest distance T1 in the Z-direction (height direction) is 140 μm or less between the inner circumferential surface of the coil conductor layer 25 on the bottom surface 17 side and the bottom surface 17 of the element body 10 opposite to this inner circumferential surface. A shortest distance T2 in the Z-direction (height direction) is 140 μm or less between the inner circumferential surface of the coil conductor layer 25 on the top surface 18 side and the top surface 18 of the element body 10 opposite to this inner circumferential surface.

The measurement positions on the inner circumferential surface of the coil conductor layer 25 for the outer surface of the element body 10 are assumed to be on the center lines (dashed-dotted lines of FIG. 3) of the respective surfaces of the element body 10 when viewed in the Y-direction. The relationship between the inner circumferential surface of the coil conductor layer 25 connected to the second external electrode 40 and the outer surface of the element body 10 is the same as the coil conductor layer 25 of FIG. 3.

Therefore, at least a portion of the coil conductor layer 25 can be arranged within a certain range from the outer surface of the element body 10 (hereinafter referred to as an outer surface region of the element body 10). When the element body 10 is degreased at a firing step of manufacturing of the inductor component 1, the degreasing proceeds from the outer surface of the element body 10 toward the center and, since the coil conductor layers 25 can be arranged in the outer surface region of the element body 10, both the coil conductor layers 25 and the outer surface region of the element body 10 are easily put into a degreased state. Therefore, variation in shrinkage behavior can be reduced in the coil conductor layers 25 and the outer surface region of the element body 10, so that the delamination can be reduced between the coil conductor layers 25 and the element body 10 or between the multiple insulating layers 11 constituting the element body 10.

In short, the degreasing proceeds as an organic component of the element body 10 is removed from the outer surface of the element body 10 when thermal energy is applied. However, since the transfer of the thermal energy to the inside of the element body 10 is inversely proportional to a polynomial function with a degree of two or higher, it is considered that only a certain range can reliably be degreased in a realistic degreasing time from the outer surface of the element body 10 toward the inside of the element body 10. As a result of intensive studies, the present inventors found that the distance from the outer surface of the element body 10 defined as the certain range is 140 μm or less.

When heat is applied to the element body 10 during manufacturing or use of the inductor component 1, the element body 10 is subjected to a stress, and the stress easily escapes in the outer surface region of the element body 10 and hardly causes deformation. Therefore, since the coil conductor layers 25 can be arranged in the outer surface region of the element body 10, the delamination can be reduced.

On the other hand, when heat is applied to the element body 10, the element body 10 is subjected to a stress, and the stress hardly escapes in the center region of the element body 10 as compared to the outer surface region of the element body 10, so that concentration of the stress tends to cause deformation. Therefore, if the coil conductor layers 25 are present in the center region of the element body 10, the delamination may occur because of deformation due to the stress of the element body itself.

As shown in FIG. 3, when a length L0 of the element body 10 is 0.6 mm and a height T0 of the element body 10 is 0.4 mm, the shortest distances L1, T1, and T2 are converted into proportions to the length L0 or height T0. In the X-direction, the proportion of the shortest distance L1 between the inner circumferential surface of the coil conductor layer 25 and the outer surface 16 of the element body 10 opposite to this inner circumferential surface to the length L0 of the element body 10 is 24% or less. In the Z-direction, the proportion of the shortest distances T1, T2 between the inner circumferential surface of the coil conductor layer 25 and the outer surfaces 17, 18 of the element body 10 opposite to this inner circumferential surface to the height T0 of the element body 10 is 36% or less. Therefore, the delamination can further be reduced.

Preferably, the shortest distance L1 in the X-direction between the inner circumferential surface of the coil conductor layer 25 and the outer surface 16 of the element body 10 opposite to this inner circumferential surface is equal to or greater than the shortest distances T1, T2 in the Z-direction between the inner circumferential surface of the coil conductor layer 25 and the outer surfaces 17, 18 of the element body 10 opposite to this inner circumferential surface. Therefore, the inner circumferential surface of the coil conductor layer 25 can be brought closer to the center of the element body 10 in the X-direction, and the coil conductor layer 25 can be formed into a shape closer to a true circle and the Q-value can be made higher. Preferably, the shortest distance T1 is equal to or greater than the shortest distance T2. Therefore, the coil conductor layer 25 can be separated from the first and second external electrodes 30, 40 in the Z-direction.

As shown in FIG. 3, the length L0 of the element body 10 is greater than the height T0 of the element body 10. A line width b of a portion of the coil conductor layer 25 extending in the Z-direction is smaller than a line width a of a portion of the coil conductor layer 25 extending in the X-direction. Therefore, a distance can be ensured between the portion of the coil conductor layer 25 extending in the Z-direction and the first and second external electrodes 30, 40. Additionally, since the coil conductor layer 25 can be formed into a shape closer to a true circle, the Q-value can be made higher. The L-value can be adjusted by changing the line width b of the portion of the coil conductor layer 25 extending in the Z-direction and the line width a of the portion of the coil conductor layer 25 extending in the X-direction. For example, by increasing the line width a of the portion of the coil conductor layer 25 extending in the X-direction, the L-value can be reduced.

The line widths of the coil conductor layer 25 connected to the second external electrode 40 are the same as the coil conductor layer 25 of FIG. 3.

Figure 4:
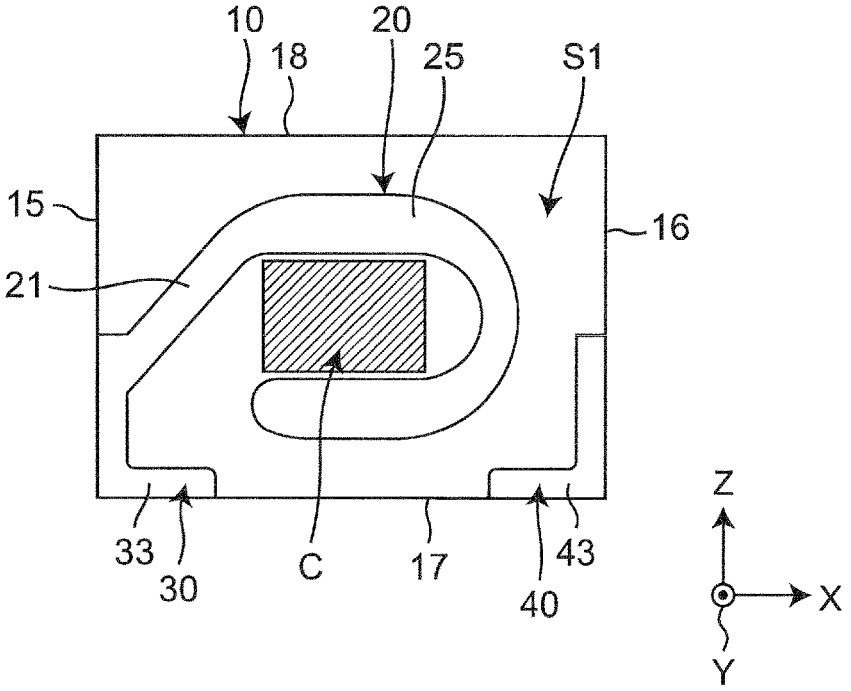
FIG. 4 is a simplified plane view of the coil conductor layer connected to the first external electrode.

FIG. 4 is a simplified plane view of the coil conductor layer 25 connected to the first external electrode 30. As shown in FIG. 4, the element body 10 includes a first plane S1 including the X- and Z-directions and intersecting the coil conductor layer 25. The first plane S1 includes at the center thereof a center region C having a similar shape acquired by scaling down the first plane S1. The area of the center area C is 25% of the area of the first plane S1. The coil conductor layer 25 does not overlap the center region C.

Consequently, the coil conductor layer 25 can be disposed in the outer surface region of the element body 10, and the variation in shrinkage behavior due to degreasing can be reduced in the coil conductor layer 25 and the outer surface region of the element body 10, so that the delamination can be reduced.

The relationship between the coil conductor layer 25 connected to the second external electrode 40 and the center region of the element body is the same as the coil conductor layer 25 of FIG. 4. In this case, the first plane is a plane including the X direction and the Z direction and intersecting the coil conductor layer 25 connected to the second external electrode 40.

Second Embodiment

A second embodiment of the inductor component of the present disclosure will be described. Out of the configuration that "the shortest distance is 140 μm or less between the inner circumferential surface of the coil conductor layer and the outer surface of the element body opposite to this inner circumferential surface", the configuration that "the line width of the portion of the coil conductor layer extending in the height direction is smaller than the line width of the portion of the coil conductor layer extending in the length direction", and the configuration that "the coil conductor layer does not overlap the center region of the element body" of the first embodiment, the second embodiment has the configuration that "the line width of the portion of the coil conductor layer extending in the height direction is smaller than the line width of the portion of the coil conductor layer extending in the length direction".

Specifically, in the second embodiment, referring to FIG. 3, at least one of the coil conductor layers 25 has the line width b of the portion of the coil conductor layer 25 extending in the Z-direction smaller than the line width a of the portion of the coil conductor layer 25 extending in the X-direction. Consequently, the portion of the coil conductor layer 25 extending in the Z-direction and the portion of the coil conductor layer 25 extending in the X-direction can be arranged in the outer surface region of the element body 10. Although the element body 10 is subjected to a stress when heat is applied to the element body 10 during manufacturing or use of the inductor component 1, the stress easily escapes in the outer surface region of the element body 10 and hardly causes deformation. Since the coil conductor layer 25 can be disposed in the outer surface region of the element body 10, delamination can be reduced between the coil conductor layers 25 and the element body 10 or between the multiple insulating layers 11 constituting the element body 10.

The second embodiment may include at least one of the configurations that "the shortest distance is 140 μm or less between the inner circumferential surface of the coil conductor layer and the outer surface of the element body opposite to this inner circumferential surface" and the configuration that "the coil conductor layer does not overlap the center region of the element body" of the first embodiment.

Third Embodiment

A third embodiment of the inductor component of the present disclosure will be described. Out of the configuration that "the shortest distance is 140 μm or less between the inner circumferential surface of the coil conductor layer and the outer surface of the element body opposite to this inner circumferential surface", the configuration that "the line width of the portion of the coil conductor layer extending in the height direction is smaller than the line width of the portion of the coil conductor layer extending in the length direction", and the configuration that "the coil conductor layer does not overlap the center region of the element body" of the first embodiment, the third embodiment has the configuration that "the coil conductor layer does not overlap the center region of the element body".

Specifically, in the third embodiment, referring to FIG. 4, at least one of the coil conductor layers 25 does not overlap the center region C of the first plane S1 of the element body 10. Consequently, the coil conductor layer 25 can be arranged in the outer surface region of the element body 10. Although the element body 10 is subjected to a stress when heat is applied to the element body 10 during manufacturing or use of the inductor component 1, the stress easily escapes in the outer surface region of the element body 10 and hardly causes deformation. Since the coil conductor layer 25 can be disposed in the outer surface region of the element body 10, delamination can be reduced between the coil conductor layers 25 and the element body 10 or between the multiple insulating layers 11 constituting the element body 10.

The third embodiment may include at least one of the configurations that "the shortest distance is 140 μm or less between the inner circumferential surface of the coil conductor layer and the outer surface of the element body opposite to this inner circumferential surface" and the configuration that "the line width of the portion of the coil conductor layer extending in the height direction is smaller than the line width of the portion of the coil conductor layer extending in the length direction" of the first embodiment.

The present disclosure is not limited to the embodiments and can be changed in design without departing from the spirit of the present disclosure. For example, respective feature points of the first to third embodiments may variously be combined.

Although the two coil conductor layers are included in the embodiments, three or more layers may be included. Although the two external electrodes are included in the embodiments, three or more external electrodes may be included. Although the external electrodes are L-shaped electrodes in the embodiment, the electrodes may be five-surface electrodes disposed over the end surfaces of the element body and the four surfaces between both end surfaces of the element body.

In the embodiments, all the coil conductor layers have the shortest distance of 140 μm or less in the length and height directions between the inner circumferential surface of the coil conductor layer and the outer surface of the element body opposite to this inner circumferential surface; however, at least one coil conductor layer may have the shortest distance of 140 μm or less in at least one of the length and height directions between the inner circumferential surface of the coil conductor layer and the outer surface of the element body opposite to this inner circumferential surface and, in this case, the delamination can be reduced near the at least one coil conductor layer.

In the embodiments, all the coil conductor layers have the line width of the portion extending in the height direction smaller than the line width of the portion extending in the length direction; however, at least one coil conductor layer may have the line width of the portion extending in the height direction smaller than the line width of the portion extending in the length direction and, in this case, the at least one coil conductor layer can be formed into a shape close to a true circle while maintaining the distance to the external electrode, so as to increase Q-value and adjust the L-value.

In the embodiments, all the coil conductor layers do not overlap the center region of the first plane of the element body; however, at least one coil conductor layer may not overlap the center region of the first plane of the element body and, in this case, the delamination can be reduced near the at least one coil conductor layer.

Example

An example of a method of manufacturing the inductor component 1 of the first embodiment will hereinafter be described.

First, an insulating paste mainly composed of borosilicate glass is repeatedly applied by screen printing to form an insulating paste layer. The insulating paste layer is an outer-layer insulator layer located outside the coil conductor layer. A photosensitive conductive paste layer is applied and formed.

Subsequently, a coil conductor layer and an external electrode conductor layer are formed by a photolithography step. Specifically, a photosensitive conductive paste containing Ag as a main metal component is applied by screen printing to form a photosensitive conductive paste layer. Ultraviolet rays etc. are then applied through a photomask to the photosensitive conductive paste layer and followed by development with an alkaline solution etc. As a result, the coil conductor layer is formed on the insulating paste layer. At this step, the coil shape and the coil position (distance from the outer shape of the element body) of the present disclosure can be acquired by drawing a desired coil pattern on the photomask.

Subsequently, an insulating paste layer provided with an opening and a via hole is formed by a photolithography step. Specifically, a photosensitive insulating paste is applied by screen printing and formed on an insulating paste layer. Ultraviolet rays etc. are then applied through a photomask to the photosensitive insulating paste layer and followed by development with an alkaline solution etc. The opening is a cross-shaped hole connected to the external electrode conductor layer.

Subsequently, a coil conductor layer and an external electrode conductor layer are formed by a photolithography step. Specifically, a photosensitive conductive paste containing Ag as a main metal component is applied by screen printing to form a photosensitive conductive paste layer. Ultraviolet rays etc. are then applied through a photomask to the photosensitive conductive paste layer and followed by development with an alkaline solution etc. As a result, the external electrode conductor layer is formed in the opening, the via hole conductor is formed in the via hole, and the coil conductor layer is formed on the insulating paste layer.

Subsequently, the step described above is repeated to form a coil conductor layer and an external electrode conductor layer on the insulating paste layer.

Subsequently, the insulating paste is repeatedly applied by screen printing to form an insulating paste layer. The insulating paste layer is an outer-layer insulator layer located outside a coil conductor layer part.

Through the steps described above, a mother laminated body is acquired. Subsequently, the mother laminated body is cut into multiple unfired laminated bodies by dicing etc. At the step of cutting the mother laminated body, the external electrodes are exposed from the laminated bodies on cut surfaces formed by cutting.

The unfired laminated bodies are then fired under predetermined conditions to acquire laminated bodies. These laminated bodies are subjected to barrel finishing. Portions of the external electrodes exposed from the laminated bodies are subjected to Sn plating having a thickness of 2 μm to 10 μm and Ni plating having a thickness of 2 μm to 10 μm.

Through the steps described above, inductor components of 0.6 mm×0.3 mm×0.4 mm are completed.

The method of forming the conductor pattern is not limited to the above method and may be, for example, a printing lamination construction method of a conductor paste using a screen printing plate opened in a conductor pattern shape, may be a method using etching for forming a pattern of a conductive film formed by a sputtering method, a vapor deposition method, pressure bonding of a foil, etc., or may be a method in which formation of a negative pattern is followed by formation of a conductor pattern with a plating film and subsequent removal of unnecessary portions as in a semi-additive method.

The conductive material is not limited to the Ag paste as described above and may be a good conductor such as Ag, Cu, and Au formed by a sputtering method, a vapor deposition method, pressure bonding of a foil, etc.

The method of forming the insulating layers as well as the openings and the via holes is not limited to the above method and may be a method in which after pressure bonding, spin coating, or spray application of an insulating material sheet, the sheet is opened by laser or drilling.

The insulating material is not limited to the grass and ceramic materials as described above and may be an organic material such as an epoxy resin, a fluororesin, and a polymer resin, or may be a composite material such as a glass epoxy resin although a material low in dielectric constant and dielectric loss is desirable.

The size of the inductor component is not limited to the above description. Particularly, the disclosure is useful for an inductor component with a size including a region difficult to degrease at 140 μm or more from an outer surface of an element. The method of forming the external electrodes is not limited to the method of applying plating to external conductors exposed by cutting, and may be a method in which external electrodes are formed after cutting by further performing dipping of a conductor paste, a sputtering method, etc., followed by plating applied thereon.

Figure 5:
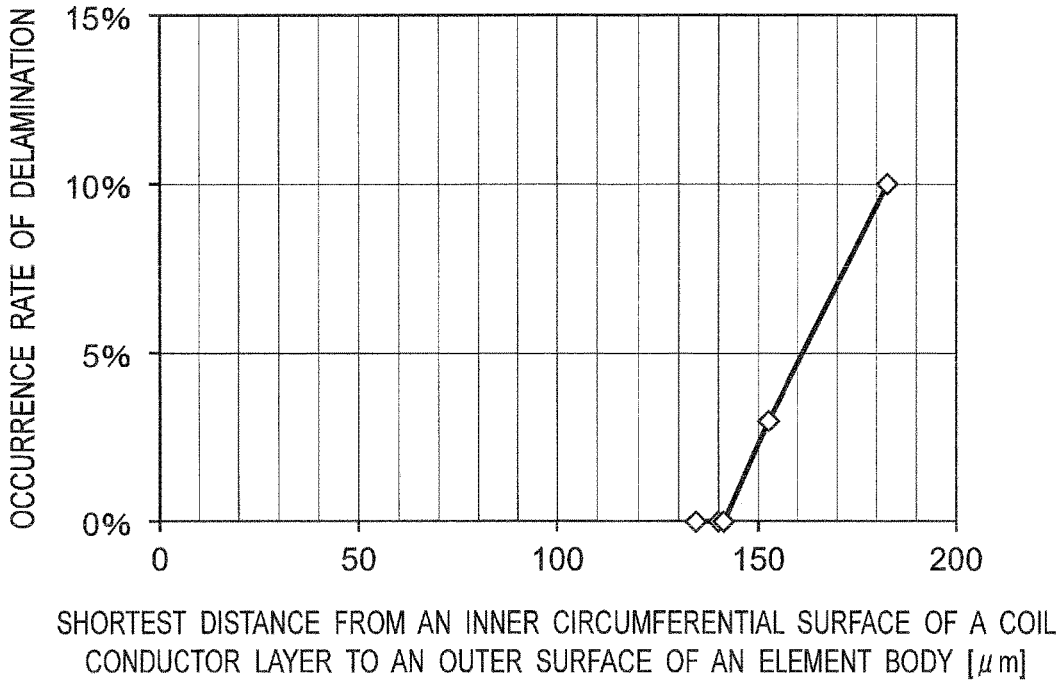
FIG. 5 is a graph of a relationship between a shortest distance from an inner circumferential surface of a coil conductor layer to an outer surface of an element body and an occurrence rate of delamination.

An effect of an example of the inductor component 1 of the first embodiment will be described. FIG. 5 shows a graph having the horizontal axis indicative of the shortest distance between the inner circumferential surface of the coil conductor layer and the outer surface of the element body and the vertical axis indicative of the occurrence rate of delamination.

Table 1 shows specific numerical values of FIG. 5. The chip size is 0.6 mm in length (L-dimension) and 0.4 mm in height (T-dimension). An L-dimensional ratio is a ratio of the shortest distance in the length direction to the chip length (0.6 mm). A T-dimensional ratio is a ratio of the shortest distance in the height direction to the chip height (0.4 mm). One side of the L-dimensional ratio means that the shortest distance is set on one side in the length direction of the chip, and both sides of the T-dimensional ratio mean that the shortest distance is set on both sides in the length direction of the chip.

TABLE 1

| shortest distance | delamination occurrence | L-dimensional ratio | | T-dimensional ratio | |
|---|---|---|---|---|---|
| [μm] | rate | one side | both sides | one side | both sides |
| 134.4 | 0% | 23.0% | 46.0% | 34.3% | 68.6% |
| 140.0 | 0% | 24.0% | 47.9% | 35.7% | 71.4% |
| 141.3 | 0% | 24.2% | 48.4% | 36.0% | 72.1% |
| 152.7 | 3% | 26.1% | 52.3% | 39.0% | 77.9% |
| 182.7 | 10% | 31.3% | 62.6% | 46.6% | 93.2% |

As shown in FIG. 5 and Table 1, it was confirmed that by setting the shortest distance to 140 μm (the L-dimensional ratio of 24.2% or less and the T-dimensional ratio of 36.0% or less), the delamination occurrence rate can be 0%. Although the example of the certain chip size has been described above, the present disclosure is obviously applicable to chip sizes other than the above because of the relationship between the degreasing time and the degreasing region described above.

The invention claimed is:

1. An inductor component comprising:

an element body defined by a length, a height, and a width;

a coil disposed in the element body and helically wound in the width direction; and first and second external electrodes disposed in the element body and electrically connected to the coil, wherein the coil includes a plurality of coil conductor layers arranged side by side in the width direction, wherein the plurality of coil conductor layers is each wound in parallel with a plane including the length direction and the height direction, wherein at least one of the coil conductor layers has a shortest distance of 140 μm or less in at least one of the length and height directions between an inner circumferential surface of the coil conductor layer and an outer surface of the element body opposite to this inner circumferential surface.

2. The inductor component according to claim 1, wherein the shortest distance is 140 μm or less in the length direction and the height direction between the inner circumferential surface of the coil conductor layer and the outer surface of the element body opposite to the inner circumferential surface.

3. The inductor component according to claim 1, wherein all the coil conductor layers have the shortest distance of 140 μm or less between the inner circumferential surface of the coil conductor layer and the outer surface of the element body opposite to the inner circumferential surface.

4. The inductor component according to claim 1, wherein the length of the element body is 0.6 mm, wherein the height of the element body is 0.4 mm, wherein in the length direction, a proportion of the shortest distance between the inner circumferential surface of the at least one coil conductor layer and the outer surface of the element body opposite to the inner circumferential surface to the length of the element body is 24% or less, and wherein in the height direction, a proportion of the shortest distance between the inner circumferential surface of the at least one coil conductor layer and the outer surface of the element body opposite to the inner circumferential surface to the height of the element body is 36% or less.

5. The inductor component according to claim 4, wherein the shortest distance in the length direction between the inner circumferential surface of the coil conductor layer and the outer surface of the element body opposite to the inner circumferential surface is equal to or greater than the shortest distance in the height direction between the inner circumferential surface of the coil conductor layer and the outer surface of the element body opposite to the inner circumferential surface.

6. The inductor component according to claim 1, wherein the outer surface of the element body includes a first end surface and a second end surface opposite to each other in the length direction and a top surface and a bottom surface opposite to each other in the height direction, wherein the first external electrode is disposed over the first end surface and the bottom surface, and wherein the second external electrode is disposed over the second end surface and the bottom surface.

7. The inductor component according to claim 6, wherein the length of the element body is greater than the height of the element body, and wherein a line width of a portion of the at least one coil conductor layer extending in the height direction is smaller than a line width of a portion of the at least one coil conductor layer extending in the length direction.

8. The inductor component according to claim 1, wherein the element body includes a first plane including the length direction and the height direction and intersecting the at least one coil conductor layer, wherein the first plane includes at a center thereof a center region having a similar shape acquired by scaling down the first plane, wherein the area of the center area is 25% of the area of the first plane, and wherein the at least one coil conductor layer does not overlap the center region.

9. An inductor component comprising:

an element body defined by a length, a height, and a width;

a coil disposed in the element body and helically wound in the width direction; and first and second external electrodes disposed in the element body and electrically connected to the coil, wherein the length of the element body is greater than the height of the element body, wherein the coil includes a plurality of coil conductor layers arranged side by side in the width direction, wherein the plurality of coil conductor layers is each wound in parallel with a plane including the length direction and the height direction, wherein the at least one coil conductor layer has a line width of a portion of the coil conductor layer extending in the height direction smaller than a line width of a portion of the coil conductor layer extending in the length direction.

10. An inductor component comprising:

an element body defined by a length, a height, and a width;

a coil disposed in the element body and helically wound in the width direction; and first and second external electrodes disposed in the element body and electrically connected to the coil, wherein the coil includes a plurality of coil conductor layers arranged side by side in the width direction, wherein the plurality of coil conductor layers is each wound in parallel with a plane including the length direction and the height direction, wherein the element body includes a first plane including the length direction and the height direction and intersecting at least one of the coil conductor layers, wherein the first plane includes at a center thereof a center region having a similar shape acquired by scaling down the first plane, wherein the area of the center area is 25% of the area of the first plane, and wherein the at least one coil conductor layer does not overlap the center region.

* * * * *